US010443402B2

(12) United States Patent
Burford et al.

(10) Patent No.: US 10,443,402 B2
(45) Date of Patent: Oct. 15, 2019

(54) THERMAL SHIELDING IN A GAS TURBINE

(71) Applicant: ROLLS-ROYCE plc, London (GB)

(72) Inventors: Peter C Burford, Derby (GB); John Dawson, Derby (GB); Parth Shah, Derby (GB)

(73) Assignee: ROLLS-ROYCE plc, London (GB)

( * ) Notice: Subject to any disclaimer, the term of this patent is extended or adjusted under 35 U.S.C. 154(b) by 435 days.

(21) Appl. No.: 15/258,701

(22) Filed: Sep. 7, 2016

(65) Prior Publication Data

US 2017/0198589 A1 Jul. 13, 2017
US 2018/0252109 A9 Sep. 6, 2018

(30) Foreign Application Priority Data

Sep. 21, 2015 (GB) ..... 1516657.2
Oct. 28, 2015 (GB) ..... 1519026.7

(51) Int. Cl.

*F01D 5/18* (2006.01)
*F01D 11/00* (2006.01)
*F01D 5/08* (2006.01)
*F01D 5/30* (2006.01)

(52) U.S. Cl.

CPC ..... *F01D 5/187* (2013.01); *F01D 5/081* (2013.01); *F01D 5/082* (2013.01); *F01D 5/3007* (2013.01); *F01D 5/3015* (2013.01); *F01D 11/003* (2013.01); *F05D 2220/32* (2013.01); *F05D 2230/21* (2013.01); *F05D 2230/239* (2013.01);

(Continued)

(58) Field of Classification Search

None

See application file for complete search history.

(56) References Cited

U.S. PATENT DOCUMENTS 3,395,891 A 8/1968 Burge
4,047,837 A 9/1977 Hueber et al.
4,279,572 A 7/1981 Auriemma (Continued)

FOREIGN PATENT DOCUMENTS

DE 102006054154 A1 5/2008
EP 1772592 A2 4/2007

(Continued)

OTHER PUBLICATIONS

Jan. 30, 2017 Search Report issued in British Patent Application No. 16187635.4.

(Continued)

*Primary Examiner* — Justin D Seabe
*Assistant Examiner* — Jason A Fountain
(74) *Attorney, Agent, or Firm* — Oliff PLC

(57) ABSTRACT

A turbine blade includes a labyrinth of internal channels for the circulation of coolant received through an inlet formed in a terminal portion of the blade root and leading to a duct-defined wall. A first passage intersects the duct and extends through the blade towards a tip. An end of the first passage is arranged to capture incoming coolant flow. A second passage intersects the duct at a position downstream of the first passage intersection. The duct and/or the passage intersections are configured to create a pressure drop in the duct in the direction from the inlet to the second passage intersection. In an axial direction, a duct wall terminates at a position between the inlet and the second passage intersection.

17 Claims, 4 Drawing Sheets

(52) U.S. Cl.
CPC ..... *F05D 2230/31* (2013.01); *F05D 2260/20* (2013.01)

(56) References Cited

U.S. PATENT DOCUMENTS

| | | | | |
|---|---|---|---|---|
| 5,941,687 | A | 8/1999 | Tubbs | |
| 8,113,784 | B2 * | 2/2012 | Gupta | F01D 5/14 415/115 |
| 9,051,838 | B2 * | 6/2015 | Wardle | F01D 5/081 |
| 9,188,011 | B2 * | 11/2015 | Khanin | F01D 5/187 |
| 10,151,205 | B2 * | 12/2018 | Barry | B23P 15/02 |
| 2004/0115054 | A1 | 6/2004 | Balland et al. | |
| 2006/0275125 | A1 | 12/2006 | Bibor et al. | |
| 2010/0239430 | A1 * | 9/2010 | Gupta | F01D 5/14 416/97 R |
| 2012/0134845 | A1 * | 5/2012 | Khanin | F01D 5/187 416/97 R |
| 2012/0163995 | A1 * | 6/2012 | Wardle | F01D 5/081 416/97 R |
| 2016/0312620 | A1 * | 10/2016 | Diamond | B23P 15/02 |
| 2016/0312621 | A1 * | 10/2016 | Barry | B23P 15/02 |
| 2017/0022817 | A1 * | 1/2017 | Alpan | F01D 5/082 |

FOREIGN PATENT DOCUMENTS

| | | | |
|---|---|---|---|
| EP | 2 400 116 | A2 | 12/2011 |
| EP | 3 088 669 | A1 | 11/2016 |
| GB | 2452515 | A | 3/2009 |

OTHER PUBLICATIONS

Mar. 7, 2016 Search Report issued in British Patent Application No. GB1519026.7.

Feb. 1, 2016 Search Report issued in British Application No. GB1516657.2.

U.S. Appl. No. 15/258,721, filed Sep. 7, 2016 in the name of John Dawson.

Jan. 11, 2019 Office Action issued in U.S. Appl. No. 15/258,721.

* cited by examiner

A-A

THERMAL SHIELDING IN A GAS TURBINE

TECHNICAL FIELD OF THE INVENTION

The present disclosure concerns thermal shielding in a gas turbine, more particularly, thermal shielding of the bucket groove where a turbine blade root meets the turbine disc. It also concerns control of leakage flow between the bucket groove and a terminal portion of the blade root.

BACKGROUND TO THE INVENTION

In a gas turbine engine, ambient air is drawn into a compressor section. Alternate rows of stationary and rotating aerofoil blades are arranged around a common axis, together these accelerate and compress the incoming air. A rotating shaft drives the rotating blades. Compressed air is delivered to a combustor section where it is mixed with fuel and ignited. Ignition causes rapid expansion of the fuel/air mix which is directed in part to propel a body carrying the engine and in another part to drive rotation of a series of turbines arranged downstream of the combustor. The turbines share rotor shafts in common with the rotating blades of the compressor and work, through the shaft, to drive rotation of the compressor blades.

It is well known that the operating efficiency of a gas turbine engine is improved by increasing the operating temperature. The ability to optimise efficiency through increased temperatures is restricted by changes in behaviour of materials used in the engine components at elevated temperatures which, amongst other things, can impact upon the mechanical strength of the blades and rotor disc which carries the blades. This problem is addressed by providing a flow of coolant through and/or over the turbine rotor disc and blades.

It is known to take off a portion of the air output from the compressor (which is not subjected to ignition in the combustor and so is relatively cooler) and feed this to surfaces in the turbine section which are likely to suffer damage from excessive heat. Typically the cooling air is delivered adjacent the rim of the turbine disc and directed to a port which enters the turbine blade body and is distributed through the blade, typically by means of a labyrinth of channels extending through the blade body.

In one known arrangement, a duct is provided integral to the blade. The duct is arranged to pass through a terminal portion of the root with an inlet at an upstream face of the terminal portion and an end at or near the downstream face of the terminal portion. At its axially upstream face, the terminal portion is profiled to conform closely to the bucket groove profile and an inner wall defines the inlet which has a similar shape to the terminal portion at the upstream face. In some arrangements, the duct walls may step down in size to produce a staged narrowing of the cross section from the upstream face to a downstream end. One or more cooling passages are provided within the blade body and extend from a root portion towards a tip portion of the blade body.

In some arrangements the cooling passages comprise a leading edge passage and a main blade or "multi-pass" passage. The leading edge passage extends root to tip adjacent the leading edge of the blade. The "multi-pass" passage is an elongate and convoluted passage which typically incorporates multiple turns in three dimensions which extend the passage between the root and tip of the blade and from a middle section of the blade body, downstream to adjacent the trailing edge of the blade. The "multi-pass" can extend from root to tip multiple times as it travels towards the trailing edge ensuring the carriage of coolant throughout the blade body (excluding the leading edge which is cooled by the leading edge passage). At the root portion end, the cooling passages are arranged to intersect with the duct. The leading edge passage may optionally connect with the main blade passage to provide a single "multi-pass" extending from leading edge to trailing edge.

In some arrangements, the multi-pass branches into two channels each of which intersect with the duct, one intersecting the duct at a position relatively upstream to the position at which the other intersects the duct. Optionally in such an arrangement, the duct is narrowed along a small segment between the two multi-pass branches and serves to meter flow to the downstream branch of the multi-pass, and hence the multi-pass channel itself. It will be appreciated that in order to allow for thermal expansion and manufacturing tolerances, there exists a small clearance space around an outer wall of the duct which faces the bucket groove.

In the described arrangements, a pressure drop occurs from the upstream end of the duct to the downstream end. A consequence of this drop can be to drive leakage flow through the clearance space between opposing faces of the terminal portion and the bucket groove. Heat transfer resulting from these leakage flows can increase thermal gradients in the turbine disc leading to the disc material being subjected to an increased stress range. The stress range to which the disc material is subjected is a limiting factor in the life of the disc.

STATEMENT OF THE INVENTION

According to the invention there is provided a turbine blade having a body enclosing a labyrinth of internal channels for the circulation of coolant received through an inlet formed in a terminal portion of the blade root, the labyrinth comprising;

an inlet arranged on an axially upstream face of the terminal portion leading to a duct defined by a wall;

in use, a clearance space between an external surface of the duct wall and a surface of a bucket groove of a disc hub in which the blade is carried, the clearance space creating a leakage path for air directed to the inlet;

a first passage intersecting the duct at a first passage intersection and extending through the blade body towards the tip of the blade, a proximal end of the first passage being arranged, in use, to capture incoming coolant flow;

a second passage intersecting the duct at a second passage intersection at a position downstream of the first passage intersection;

the duct and/or the passage intersections configured to create a pressure drop in the duct in the direction from the inlet to the second passage intersection;

wherein, in an axial direction, the wall terminates at a position between the inlet and the second passage intersection so as to balance the pressure of coolant in the duct with the pressure of coolant in the leakage path thereby reducing the mass flow of coolant entering the leakage path in the clearance space.

Optionally, a second passage inlet to the second passage is provided at the second passage intersection, the second passage inlet having a cross section which is less than that of the second passage intersection whereby to further restrict and control the distribution and pressure of coolant flowing through the duct, the passages intersecting with the duct and the clearance space. A first passage inlet to the first passage may also optionally be provided at the first passage intersection, the first passage inlet having a cross section that is less than the first passage intersection.

Positioning of the inlet in the second passage intersection in preference to within the duct reduces the pressure drop along the duct axis, which is one of the main factors driving the flow along the clearance space. Furthermore, the reduction in axial length of the wall contributes to a weight reduction of the blade without having an adverse effect on the quantum of leakage flow into the clearance space, or compromising the shielding function provided by the duct wall in a region of the bucket groove where it is most needed.

For example, the first passage may be a leading edge passage or a trailing edge passage. Additional passages may be provided axially between the first and second passages. Additional passages may join the first and/or second passage to form two inlet routes to a multipass passage.

The arrangement described provides a significant reduction in flow within the bucket groove clearance space and reduces unpredictable flow behaviour in this area. The inventors have recognised that the quantity and unpredictability of flow in this area have a significant effect on the disc volume weighted mean temperature (DVMT) gradient which is strongly associated with stress in the bucket groove with the potential to reduce the useful life of the disc. The reduction in leakage flow provided by the arrangement of the invention is expected to result in disc life improvement.

The terms upstream and downstream in this context refer to the direction of flow of coolant arranged to enter the inlet. This may be the same or an opposite direction to the direction of flow of a working fluid passing over the hub and blade in an operating gas turbine. The coolant may be air, for example in the case of a gas turbine engine, the coolant is air drawn from the compressor of the engine bypassing the combustor.

The first passage may be a leading edge passage or a trailing edge passage. The second passage may be a main blade passage or multipass. The second passage may be a trailing edge passage. There may be more than two passages. The first and second passage may join to form a single multi-pass having two intersections with the duct. Any passage may present more than one inlet at the duct.

It will be understood that the optimum position at which the wall terminates will vary with, inter alia; the operating conditions of the turbine and geometry of the labyrinth within the blade. It is well within the abilities of the skilled addressee to determine the pressure drop in a given duct/passage configuration and to identify wall termination positions which will provide a desired pressure balancing effect.

In some embodiments, the wall terminates to an upstream side of the second passage intersection. In other embodiments, the wall terminates partway along the second passage intersection. For example, the wall extends axially to a position which is from about 50% to 85% of the axial length of the bucket groove. The wall may extend to a position which is from 40% to 60% of the axial length of the bucket groove. Alternatively, the wall may extend to a position which is from about 70% to 90% of the axial length of the bucket groove.

It will also be understood that the optimal relationships between cross sectional areas of the duct inlet, passage intersections, the second passage inlet and the axial length of the wall will vary with, inter alia; the operating conditions of the turbine and geometry of the labyrinth within the blade. It is well within the abilities of the skilled addressee to determine optimal arrangements for given operating conditions of a blade.

In embodiments now described, the duct and inlet is formed integrally with the blade in a single casting process. Alternative arrangements are contemplated where the duct wall is defined by two or more components which are subsequently joined or fastened together. For example, a duct wall portion may be manufactured using an additive layer manufacturing method and be subsequently friction welded to a cast blade portion which defines the remainder of the duct wall. For example, the duct and inlet may be provided integrally with a lock plate secured to the blade and/or disc. Alternatively, the duct and inlet may be provided in the form of an insert positioned in the assembly after the blade is received in the fir tree recess. In another alternative, the duct and inlet may be provided integrally with a seal plate secured to the blade and/or disc.

BRIEF DESCRIPTION OF THE FIGURES

Some embodiments of the invention will now be described with reference to the accompanying Figures in which.

DETAILED DESCRIPTION OF FIGURES AND EMBODIMENTS

Figure 1:
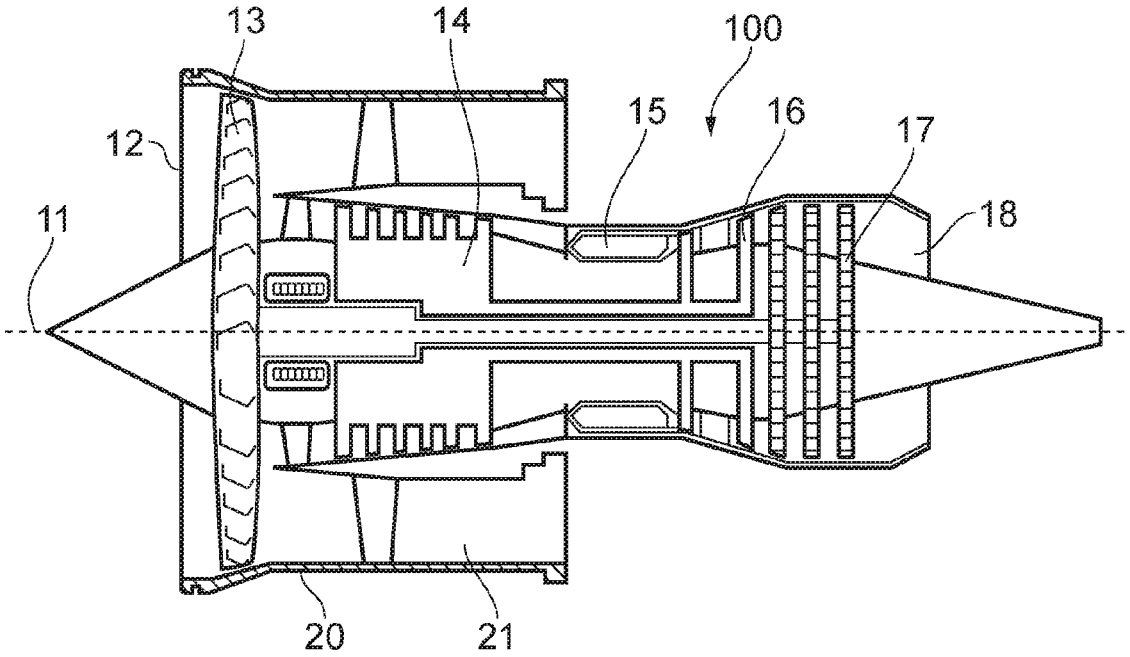
FIG. 1 is a sectional side view of a gas turbine engine.

With reference to FIG. 1, a gas turbine engine is generally indicated at 100, having a principal and rotational axis 11. The engine 10 comprises, in axial flow series, an air intake 12, a propulsive fan 13, a high-pressure compressor 14, combustion equipment 15, a high-pressure turbine 16, a low-pressure turbine 17 and an exhaust nozzle 18. A nacelle 20 generally surrounds the engine 100 and defines the intake 12.

The gas turbine engine 100 works in the conventional manner so that air entering the intake 12 is accelerated by the fan 13 to produce two air flows: a first air flow into the high-pressure compressor 14 and a second air flow which passes through a bypass duct 21 to provide propulsive thrust. The high-pressure compressor 14 compresses the air flow directed into it before delivering that air to the combustion equipment 15.

In the combustion equipment 15 the air flow is mixed with fuel and the mixture combusted. The resultant hot combustion products then expand through, and thereby drive the high and low-pressure turbines 16, 17 before being exhausted through the nozzle 18 to provide additional propulsive thrust. The high 16 and low 17 pressure turbines drive respectively the high pressure compressor 14 and the fan 13, each by a suitable interconnecting shaft.

Other gas turbine engines to which the present disclosure may be applied may have alternative configurations. By way of example such engines may have an alternative number of interconnecting shafts (e.g. three) and/or an alternative number of compressors and/or turbines. Further the engine may comprise a gearbox provided in the drive train from a turbine to a compressor and/or fan.

Figure 2:
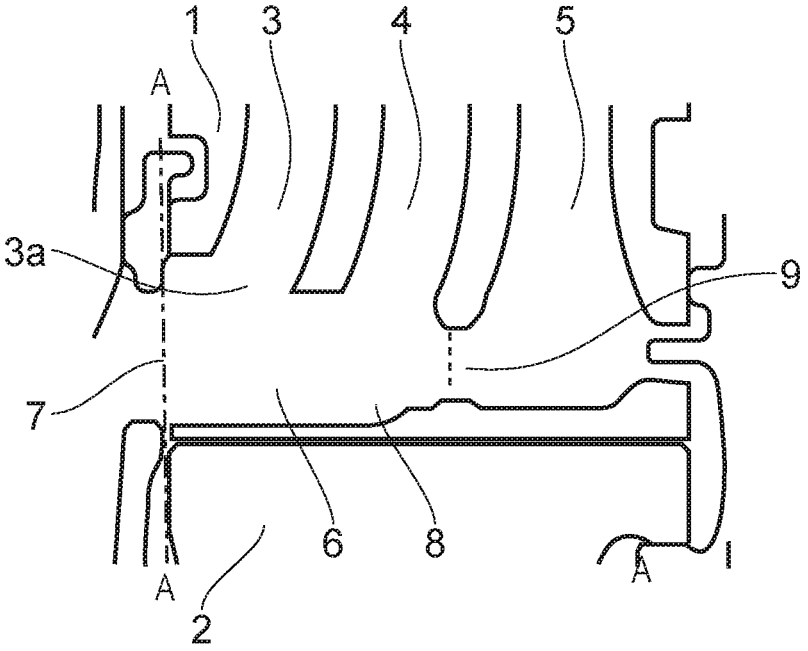
FIG. 2 shows in schematic the root of a known turbine blade.
Figure 2:
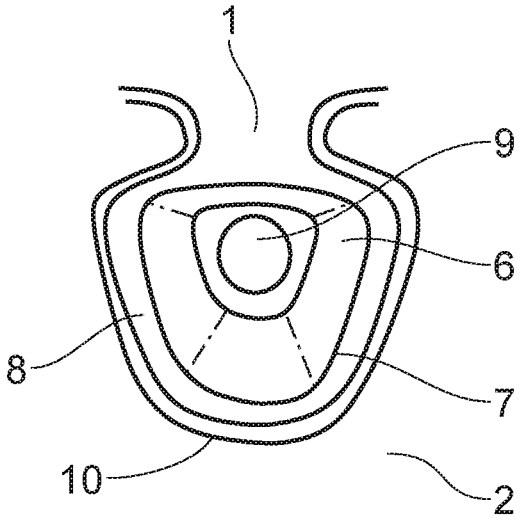

As can be seen in FIG. 2 a turbine blade has a root portion 1, extending from a blade platform (not shown). The root is received in a fir tree recess of a disc 2. A terminal portion of the root sits in the bucket groove of the disc 2 which is the radially innermost part of the fir tree recess of the disc 2. In an axially upstream face of the terminal portion of the root is provided an inlet 7 leading to a duct 6 which extends the length of the root in an upstream to downstream direction. The duct is defined by an axially extending wall 8. A clearance space 10 is present between the wall 8 and bucket groove of the disc 2.

Connecting with the duct are three passages 3, 4, 5. The first draws coolant to the leading edge of the blade. The cross section of the inlet to the third passage 5 is reduced compared to that of the first and second passage 3 and 4 inlet, to introduce a pressure drop into the duct 6 to reduce the volume of coolant. Between the second 4 and third 5 passage inlets, there is provided in the duct 6 a duct restrictor 9. This restrictor 9 narrows the cross section of the duct 6 substantially creating a pressure gradient along the duct 6 designed to encourage preferential flow in the coolant passages which serve the leading edge and mid-portion of the blade. When coolant is directed to the inlet 7, some is also drawn to the leakage path provided by the clearance space 10.

Figure 3:
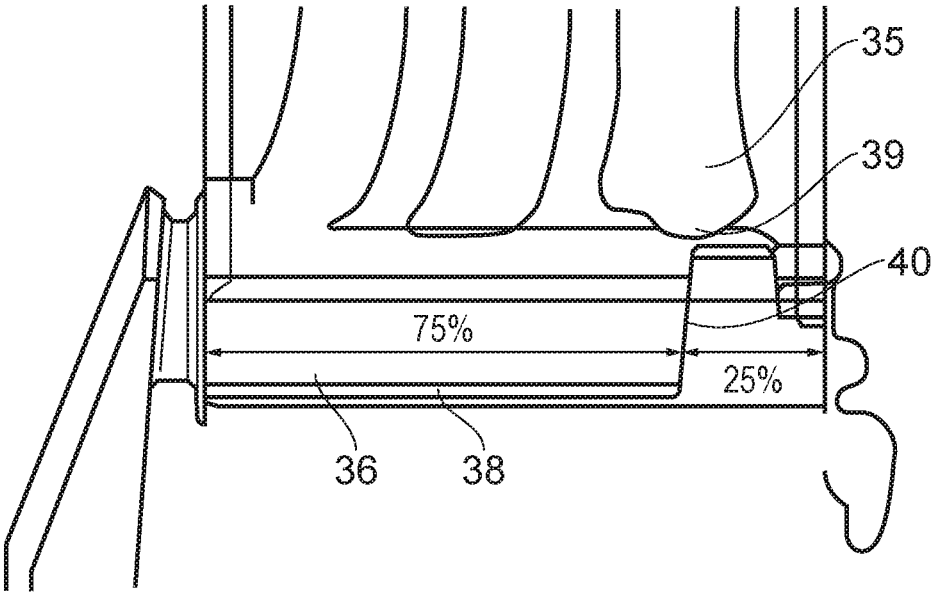
FIG. 3 shows in schematic the root of a first embodiment of a turbine blade in accordance with the invention.

FIG. 3 shows a first embodiment of the invention which adapts the arrangement of FIG. 2. As can be seen, like the arrangement of FIG. 2, the blade root is provided with a duct 36 defined by a wall 38. In this arrangement the wall has a terminal end 40 at approximately 75% along the bucket groove axis, immediately below the third passage inlet 35. There is no equivalent duct restrictor to the duct restrictor 9 of FIG. 2. The cross section of the duct remains substantially continuous along its walled length. A passage inlet is provided at a terminal end 39 of the third passage 35. This inlet is substantially smaller in cross section than the duct 36 so as to reduce the pressure and control the volume of coolant in duct 36.

Figure 4:
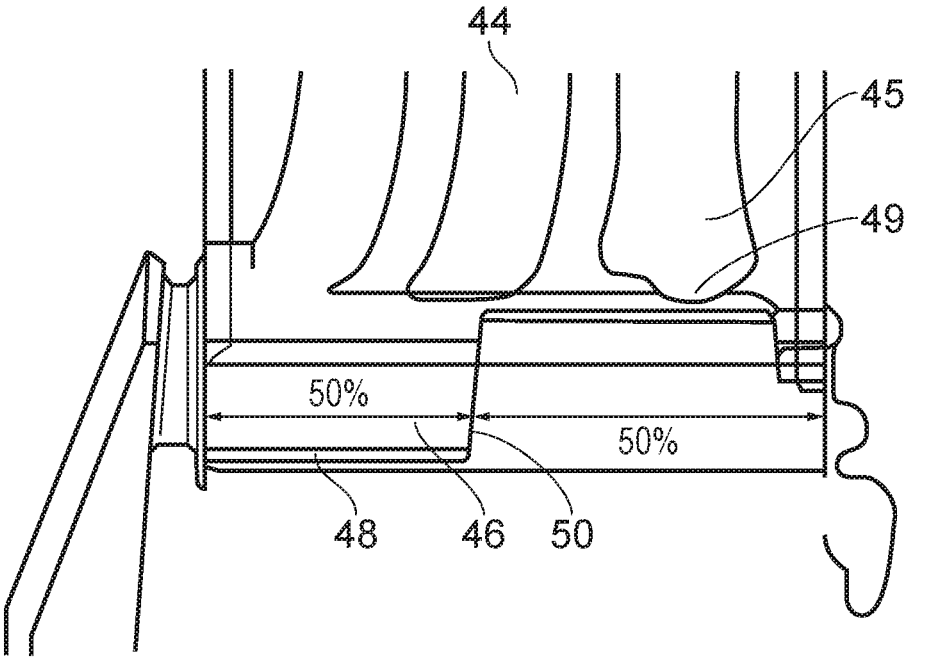
FIG. 4 shows in schematic the root of a second embodiment of a turbine blade in accordance with the invention.

FIG. 4 shows an alternative embodiment to that of FIG. 3. As can be seen, like the arrangement of FIG. 2, the blade root is provided with a duct 46 defined by a wall 48. In this arrangement the wall has a terminal end 50 at approximately 50% along the bucket groove axis, adjacent a downstream wall of a second passage 44. There is no equivalent duct restrictor to the duct restrictor 9 of FIG. 2. The cross section of the duct remains substantially continuous along its walled length. A passage inlet is provided at a terminal end 49 of the third passage 45. This inlet is substantially smaller in cross section than the duct 46 so as to introduce a pressure drop into duct 45 and control the volume of coolant air consumed.

Figure 5:
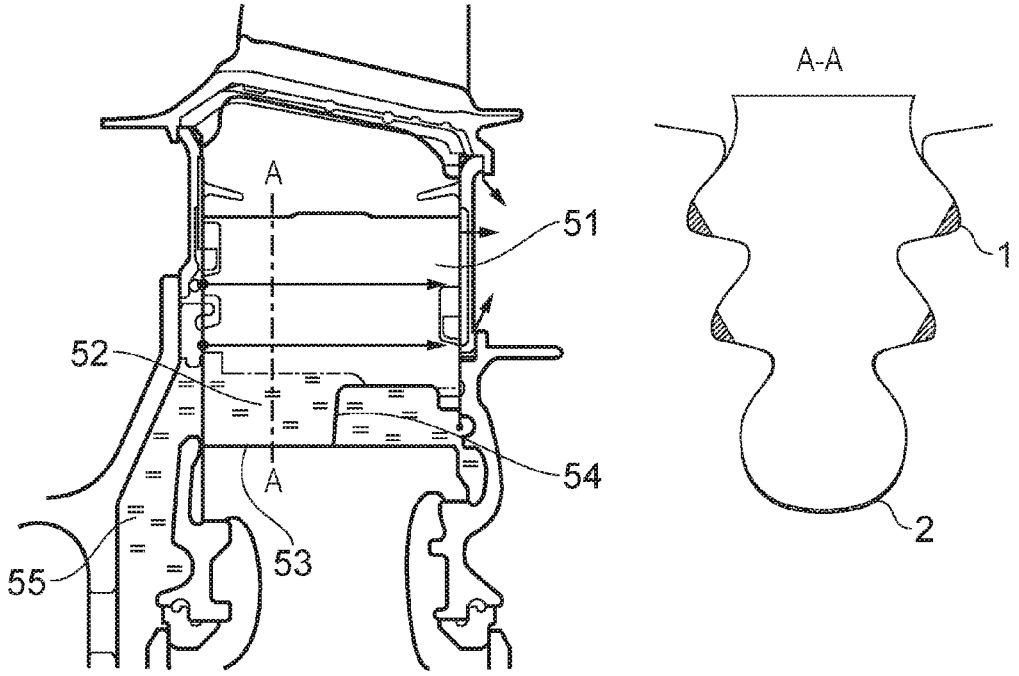
FIG. 5 shows in schematic the pressure of coolant flows in the root cooling passages and duct of an embodiment of the invention broadly similar to that of FIG. 4.

FIG. 5 illustrates the pressure of coolant flowing through different regions of the root of a blade having a configuration substantially similar to that of FIG. 4. For simplicity, the passages are not shown here, though it is to be understood that the pressure gradient represented is indicative of one in an arrangement with three passages as described in relation to FIGS. 2 to 4. As can be seen, coolant arrives in a passage 55 between the disc and a cover plate and is delivered to duct 52 which is defined by wall 53 which has a terminal end 54 positioned at approximately 50% of the axial length of the bucket groove.

In the arrangement of FIG. 2, a pressure gradient is provided along the duct 6 due to the significant difference in cross sectional area of the restrictor 9 and the inlet 7. As a consequence of this gradient, some of the coolant is drawn into the clearance space 10. In the arrangement of FIG. 5, the removal of the restrictor 9 (FIG. 2) creates a preferential flow path through the duct 52 versus the clearance space 10. In this arrangement, the pressure is substantially equal at the upstream and downstream ends of the duct 52. However, the decreasing cross-sectional size (from an upstream to a downstream direction) of inlets to the three passages from the duct/bucket groove space results in a reduced duct pressure which leads to controlling the coolant flow consumption whilst reducing potentially detrimental leakage flow in the bucket groove clearance space 10 (FIG. 2). This also leads to reduction in the leakage flows through the rear lock-plate grooves 56 (FIG. 5) and the clearance space between blade and rotor fir tree non-mating faces (FIG. 5*a*)

Figure 6:
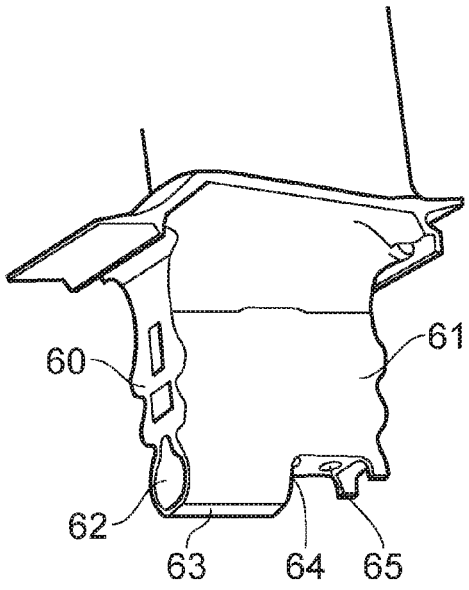
FIG. 6 shows a perspective view from the upstream end of a blade similar to that shown in FIGS. 2 and 5.
Figure 7:
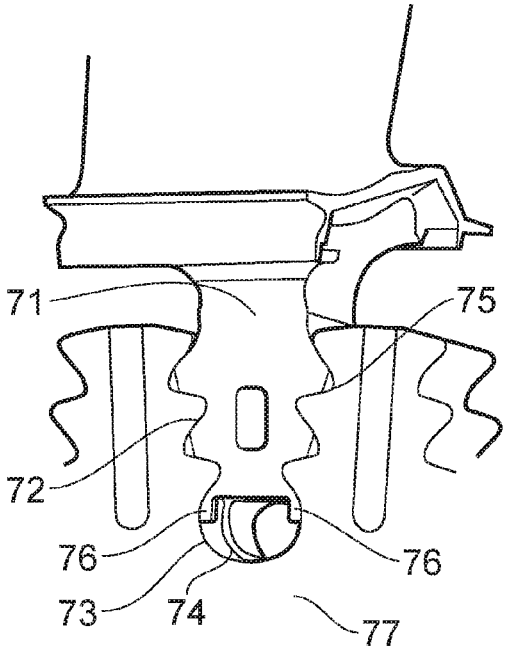
FIG. 7 shows a view from the downstream end of the blade shown in FIG. 6, in situ in a fir tree recess of a disc.

FIG. 6 shows, in perspective view, the external appearance of a blade root 61 of a blade in accordance with the invention. As can be seen from the Figure, an upstream face 60 of the root has a substantially fir tree shape. This is designed to be received in a fir tree shaped recess 72 of a disc 77 as shown in FIG. 7. A terminal portion of the blade root 61 which sits in a bucket groove 73 of a blade 77 is provided with an inlet 62 in the upstream face 60 which, with the wall 63 defines a duct. The wall has a terminal end 64. A restrictor inlet 65 is provided at an entrance to a passage (for example the third passage of FIG. 4) from the bucket groove space which is downstream of the terminal end 64 of the wall 63. In practice, the blade can be manufactured with a wall extending across the terminal end of the second passage and the restrictor inlet subsequently provided by cutting a hole into this wall section. An optimum size of the inlet can thus be selected once the operating parameters in which the blade will be used are known.

FIG. 7 shows a blade having the configuration as shown in FIG. 6, in situ in a disc 77. This Figure shows a view looking towards a downstream face 71 of the blade root. As can be seen the root sits in a fir tree recess 72. Small spaces 75 are provided between the root and disc to allow for differential expansion of components at high operating temperatures. A terminal portion of the root sits in the bucket groove 73. The terminal end of a duct wall 74 can be seen partway along the axial extent of the bucket groove 73. Projections 76 extend partly into the groove space to assist in holding the root in place. Such projections may be configured to suit other purposes, such as connecting with circumferentially adjacent blade roots in an assembled turbine rotor stage.

The skilled person will appreciate that except where mutually exclusive, a feature described in relation to any one of the above aspects may be applied mutatis mutandis to any other aspect. Furthermore except where mutually exclusive any feature described herein may be applied to any aspect and/or combined with any other feature described herein.

It will be understood that the invention is not limited to the embodiments above-described and various modifications and improvements can be made without departing from the concepts described herein. Except where mutually exclusive, any of the features may be employed separately or in combination with any other features and the disclosure extends to and includes all combinations and sub-combinations of one or more features described herein.

The invention claimed is:

1. A turbine blade having a body enclosing a labyrinth of internal channels for a circulation of coolant received through an inlet formed in a terminal portion of the blade root, the labyrinth comprising;

the inlet arranged on an axially upstream face of the terminal portion leading to a duct defined by a duct wall;

in use, a clearance space bounded by an external surface of the duct wall and a bucket groove of a disc hub in which the blade is carried, the clearance space creating a leakage path for air directed to the inlet;

a first passage intersecting the duct at a first passage intersection and extending through the blade body towards a tip of the blade, a proximal end of the first passage being arranged, in use, to capture incoming coolant flow; and a second passage intersecting the duct at a second passage intersection at a position downstream of the first passage intersection, wherein:

the duct and/or the passage intersections are configured to create a pressure drop in the duct in the direction from the inlet to the second passage intersection; and in an axial direction, the duct wall terminates at a position between the inlet and the second passage intersection so as to balance the pressure of coolant in the duct with the pressure of coolant in the leakage path thereby reducing a mass flow of coolant entering the leakage path in the clearance space.

2. The turbine blade as claimed in claim 1 wherein a second passage inlet to the second passage is provided at the second passage intersection, the second passage inlet having a cross section which is less than that of the second passage intersection.

3. The turbine as claimed in claim 1 wherein the first passage is a leading edge passage.

4. The turbine blade as claimed in claim 1 wherein the second passage is a trailing edge passage.

5. The turbine blade as claimed in claim 1 wherein a third passage joins the second passage to form two inlet routes to a multipass passage extending through a-mid-portion to a trailing edge portion of the blade body.

6. The turbine blade as claimed in claim 1 wherein the wall terminates to an upstream side of the second passage intersection.

7. The turbine blade as claimed in claim 1 wherein the wall terminates partway along the second passage intersection.

8. The turbine blade as claimed in claim 1 wherein the wall extends axially to a position which is from 50% to 85% of the axial length of the bucket groove.

9. The turbine blade as claimed in claim 6 wherein the wall extends to a position which is from 40% to 60% of the axial length of the bucket groove.

10. The turbine blade as claimed in claim 7 wherein the wall extends to a position which is from 70% to 90% of the axial length of the bucket groove.

11. The turbine blade as claimed in claim 1 wherein the duct and the inlet are formed integrally with the blade in a single casting process.

12. The turbine blade as claimed in claim 1 wherein the duct wall is defined by two or more components which are subsequently joined or fastened together.

13. The turbine blade as claimed in claim 12 wherein the duct wall is manufactured using an additive layer manufacturing method and is subsequently friction welded to a cast blade portion which defines the remainder of the duct wall.

14. The turbine blade as claimed in claim 12 wherein the duct and inlet are provided integrally with a lock plate secured to the blade and/or a disc having a bucket groove which, in use, carries the blade.

15. The turbine blade as claimed in claim 12 wherein the duct and inlet are provided in the form of an insert positioned in an assembly of the blade and a disc having a bucket groove which, in use, carries the blade, after the blade is received in the bucket groove.

16. The turbine blade as claimed in claim 12 wherein the duct and inlet are provided integrally with a seal plate secured to the disc and or a disc having a bucket groove which, in use, carries the blade.

17. A gas turbine engine comprising one or more discs having bucket grooves into which is located the turbine blade having the configuration according to claim 1.

* * * * *